US008831262B2

(12) United States Patent
McElveen

(10) Patent No.: US 8,831,262 B2
(45) Date of Patent: Sep. 9, 2014

(54) DIRECTIONAL AUDIO WAVEGUIDE ARRAY

(71) Applicant: Wave Sciences Corporation, Charleston, SC (US)

(72) Inventor: James Keith McElveen, Charleston, SC (US)

(73) Assignee: Wave Sciences LLC, Charleston, SC (US)

( * ) Notice: Subject to any disclaimer, the term of this patent is extended or adjusted under 35 U.S.C. 154(b) by 0 days.

(21) Appl. No.: 13/654,171

(22) Filed: Oct. 17, 2012

(65) Prior Publication Data

US 2013/0216083 A1 Aug. 22, 2013

Related U.S. Application Data

(60) Provisional application No. 61/599,527, filed on Feb. 16, 2012.

(51) Int. Cl.
*H04R 1/20* (2006.01)

(52) U.S. Cl.
USPC ..... 381/338; 381/337; 381/339; 181/196; 181/175

(58) Field of Classification Search
CPC ..... H04R 1/20; H04R 1/22; H04R 3/00; H04R 1/222; H04R 1/227; H04R 1/225; H04R 1/24; H04R 1/245; H04R 1/265; H04R 1/26; H04R 1/30; H04R 1/32; H04R 1/323; H04R 1/326; H04R 2430/20; H04R 1/28
USPC ..... 381/150, 337–339, 370, 382, 352, 345, 381/161; 181/175, 196
See application file for complete search history.

(56) References Cited

U.S. PATENT DOCUMENTS

| | | | | |
|---|---|---|---|---|
| 2,085,130 | A * | 6/1937 | Swickard | 181/158 |
| 2,089,391 | A * | 8/1937 | Marion | 181/188 |
| 4,000,757 | A | 1/1977 | Freeman | |
| 5,025,886 | A * | 6/1991 | Jung | 181/156 |
| 5,137,110 | A * | 8/1992 | Bedard et al. | 181/153 |
| 5,206,557 | A * | 4/1993 | Bobbio | 310/309 |
| 6,991,289 | B2 * | 1/2006 | House | 297/217.4 |

* cited by examiner

*Primary Examiner* — Ahmad Matar
*Assistant Examiner* — Sabrina Diaz
(74) *Attorney, Agent, or Firm* — Gregory Finch

(57) ABSTRACT

A directional waveguide array apparatus can transmit and/or receive airborne or fluid-borne audio with the appropriate selection of transducers. The present invention advances directional waveguide arrays by allowing construction of a directional audio device with desired frequency bandwidths, array patterns, and gain by appropriate geometric configurations of the array of waveguide channel ports, as well as dimensioning and configuration of waveguide channel and chamber parameters. Embodiments of the present invention enable increased immunity to environmental noises, temperature, and humidity; low cost of construction; high reliability; simplicity of operation; very low power consumption; real-time steering of directivity (interference) pattern; wide range of audio powers that can be transmitted or received; and interchangeable transducer types.

20 Claims, 9 Drawing Sheets

DIRECTIONAL AUDIO WAVEGUIDE ARRAY

RELATED APPLICATIONS

This application claims the benefit of U.S. Provisional Application 61/599,527, filed Oct. 19, 2011, hereby incorporated by reference.

FIELD

The present invention relates to directional audio systems, in particular, microphone and loudspeaker arrays used as directional audio systems, as well as acoustic holography, underwater acoustic, and insonification fields.

BACKGROUND

Directional audio systems work by spatially filtering received (or transmitted) audio so that sounds received (transmitted) along the steering direction are amplified and sounds received (transmitted) along other directions are reduced. The reception or transmission of sound along a particular spatial direction is a classic but difficult audio engineering problem. One means of accomplishing this is by use of a directional array of transducers. It is well known by those skilled in the art that a collection of transducers can be treated together as an array to be combined in engineered ways to spatially filter (either when transmitting or receiving) directional sounds at the particular location of the array over time. The classic means of spatial filtering consists simply of manipulating the constructive and destructive interference pattern of the various sounds that pass through the array using some engineered combination of transducer types, array geometry, time delays, phase delays, frequency filtering, amplitude filtering, and temporal filtering to create a directional interference (a.k.a. directivity) pattern.

Similarly, it is known that waveguides can be used to amplify or otherwise shape sounds traveling through them, as is accomplished in musical instruments for example. Limited scenarios for directional reception and transmission of sound have been addressed by prior devices, such as parabolic dishes, shotgun microphones, microphone arrays, and loudspeaker arrays. A variety of problems remain for prior devices.

In particular, prior array devices can be expensive to manufacture and power particularly if the steering angle of their reception (or transmission) pattern deviates from perpendicular to the plane of the array of transducers (a.k.a. broadside). This is because all audio channels are typically captured (or rendered) independently and simultaneously and steering of the array directivity pattern is accomplished by adjusting digital delays in each audio channel so that the directivity pattern of the array "points" in the correct spatial direction. As a result, signals along a preferred spatial direction are then reinforced and signals along other directions are reduced. This ability to steer the reception (or transmission) directivity pattern from the perpendicular by inserting digital delays into the audio channels is extremely useful, but involves significant levels of additional complexity, manufacturing cost, noise susceptibility, size, weight, and power. These difficulties also scale with the number of channels, quickly making the construction and operation of large steerable, array devices impractical. Many attempts have been made over the years to devise lower cost and robust ways to insert synchronized time delays into multiple audio channels but these attempts have been met with limited success.

A simpler alternative to employing array techniques to construct directional audio systems involves the use of parabolic dishes that reflect audio to or from a single transducer, as appropriate. Parabolic dish techniques are inherently very power efficient and, if of sufficient size relative to the lowest frequency of acoustic signal that the system is designed to handle, highly directional. However, parabolic dishes cannot be steered off the broadside spatial direction except by physically re-orienting the dish. The parabolic dish approach also inherently places the transducer at the focal point of the parabola—out in the environment where the transducer is subject to potentially bothersome effects. Parabolic dishes are also constrained in their shape and cannot be readily adapted for different fixtures or hosts.

What is needed, therefore, is a highly directional audio collection or production system that can operate in a wide range of environments and be applied to various fixed, portable, and mobile applications, is physically and electrically robust, power efficient, economical to manufacture and operate, steerable, inherently scalable, light weight, steerable from its broadside, noise and environment immune, and capable of being installed in fixtures which have non-planar surfaces. Previous implementations of analog and digital microphone and loudspeaker arrays have not been able address all of these concerns simultaneously.

SUMMARY

Several objects and advantages of the present invention are:

(a) to allow construction of a directional audio device that can transmit and/or receive airborne or fluid-borne audio (with appropriate selection of transducers);

(b) to allow construction of a directional audio device that can be pre-set to different spatial steering directions at the time of manufacture;

(c) to allow construction of a directional audio device with desired frequency bandwidths, array patterns, and gain by appropriate geometric configurations of the array of waveguide channel ports as well as dimensioning and configuration of waveguide channel and chamber parameters;

(d) to allow real-time steering of array pattern by adjusting the effective length of individual waveguide channels or by selecting a different set of waveguides with appropriate parameters;

(e) to allow further real-time steering of the device's array directivity pattern by adjusting the timing used to receive (transmit) signals from (to) the array of transducers;

(f) to allow construction of a directional audio device that is scalable while remaining cost effective;

(g) to allow construction of a directional audio device that can be integrated into any fixture, irrespective of the fixture's shape; and (h) to allow real-time tuning of the device's audio characteristics by adjusting waveguide parameters through the use of valves, sliders, and other types of mechanisms.

Another object of the present invention is a directional waveguide array apparatus comprising a planar exterior surface, the planar exterior surface having a plurality of apertures defining waveguide ports, the plurality of apertures being arranged in a logarithmic spiral configuration; a plurality of waveguide channels coupled to the planar exterior surface in alignment with the plurality of apertures; and at least one combining chamber coupled to a terminal portion of the plurality of waveguide channels, the at least one combining chamber having an interior portion defining a resonant cavity.

Another object of the present invention is a directional waveguide array apparatus comprising a terminating surface, the terminating surface having a plurality apertures defining waveguide ports; a plurality of waveguide channels coupled to the terminating surface in alignment with the plurality of apertures; a collar coupled to a terminal end of the plurality of waveguide channels; a reduction-expansion chamber coupled to the collar, the reduction-expansion chamber having a housing with interior walls defining a resonant cavity; and a chamber cap coupled to the reduction-expansion chamber, the chamber cap having at least one transducer coupled to a portion of the chamber cap.

Still yet another object of the present invention is a directional waveguide array apparatus comprising a terminating surface, the terminating surface having a plurality apertures defining waveguide ports; a plurality of waveguide channels coupled to the terminating surface in alignment with the plurality of apertures; a collar coupled to a terminal end of the plurality of waveguide channels; a reduction-expansion chamber coupled to the collar, the reduction-expansion chamber having a housing with interior walls defining a resonant cavity; a chamber cap coupled to the reduction-expansion chamber, the chamber cap having at least one transducer coupled to a portion of the chamber cap; a plurality of transducer electrical cables operably engaged with the at least one transducer and at least one electrical connector; and an electronics module operably engaged with the at least one electrical connector, the electronics module comprising a printed circuit board having filtering, gain control, and input-output circuitry; at least one output channel operably engaged with the printed circuit board; and at least one input channel operably engaged with the printed circuit board.

Still further objects and advantages of this invention will become apparent from a consideration of the ensuing description and drawings.

BRIEF DESCRIPTION OF DRAWINGS

In the following, an embodiment of invention will be described in more detail with reference to the drawings, where.

DETAILED DESCRIPTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

Figure 1:
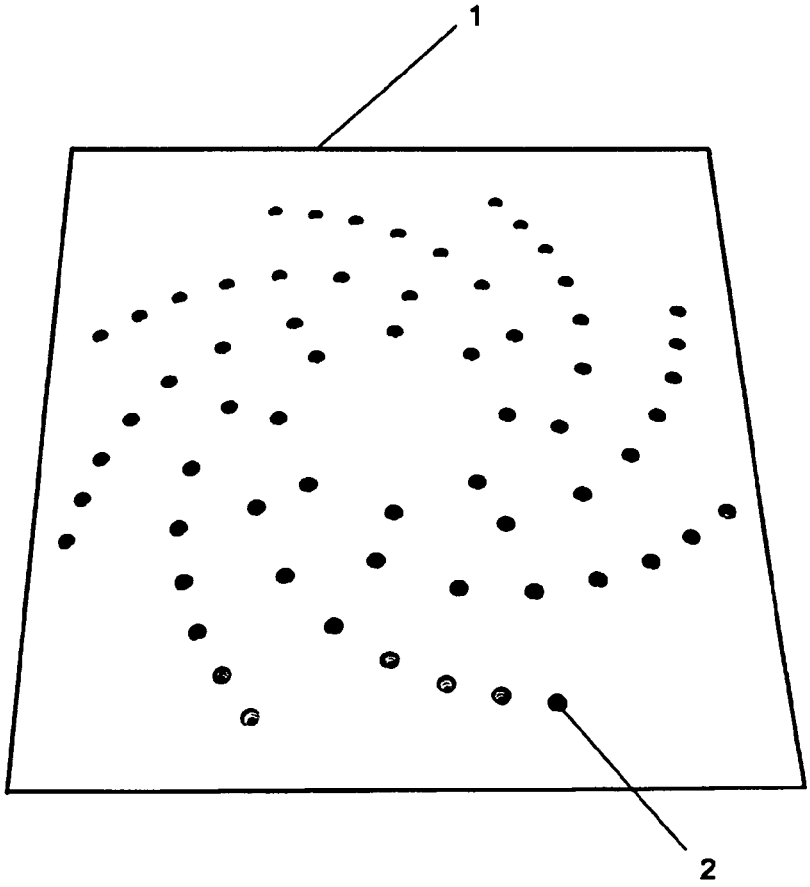
FIG. 1 is an illustration of the waveguide port configuration of an embodiment with a planar terminating surface.

Referring now to the invention in more detail, in FIG. 1 there is shown the exterior of one embodiment of the device's face as a terminating surface, referred to as exterior surface 1. Also shown is an array of waveguide channel ports 2, in an embodiment arranged in a logarithmic spiral pattern.

In more detail, still referring to the invention of FIG. 1, the ports 2 allow sound to travel into or out of the device, depending on whether it is configured to receive or transmit audio. The construction details of the invention as shown in FIG. 1 are, in an embodiment, a rigid exterior surface 1 with a planar, curved, or irregular shape with waveguide ports 2 arranged in a suitable pattern to achieve the desired directivity.

An addition to this construction technique includes the exterior surface 1 being covered with cloth or other suitable material that passes sound pressure waves to prevent dust from entering the device, improve its appearance, and/or to act as a baffle to reduce the effect of abrupt pressure changes.

Variations on this construction technique include, but are not limited to, waveguide ports arranged in the same or similar geometric pattern and on or in a host device; exterior surfaces made of other materials, such as wood, plastic, or composites; other arrangements of waveguide ports, such as equal, random, fractal, Golden Spiral, and Fibonacci spacing; surfaces with vibration or sound absorbing layers of neoprene rubber or similar materials; and the exterior surface 1 being constructed of a less-than-rigid material to allow it to bend while still allowing the waveguide channel ports to pass sound pressure waves.

Figure 2:
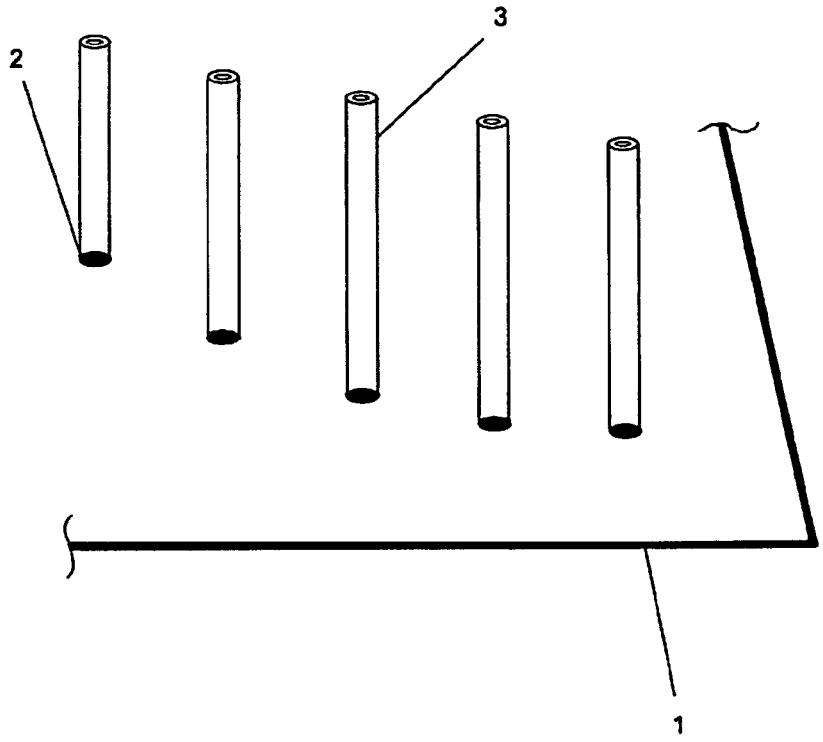
FIG. 2 is an illustration of an embodiment of individual waveguide channels and porting to the planar exterior terminating surface.

Referring now to the embodiment shown in FIG. 2, the planar exterior surface 1 has port openings 2 for the sound pressure waves to pass either into or out of the waveguide channels 3. In more detail, still referring to the invention of FIG. 2, the waveguide channels 3 continue onto a reduction or expansion chamber body 6 (shown in following figures). The construction details of the invention as shown in FIG. 2 are, in one embodiment, the waveguide channels as flexible, plastic tubes that are attached to the exterior surface 1 at the ports 2 using an adhesive. Incorporating flexible tubes allows the overall dimension of the device to be reduced as the tubes can be bent and packed more closely together, provided that the bends in the tubes are not so sharp as to significantly impede the air flow through the tubes. The ports and tubes need to be of sufficient diameter to pass the sound pressure waves with an acceptable amount of impedance loss. In an embodiment, a diameter of approximately ¼ inch may be used. The length of each waveguide channel is determined by the shape of the exterior surface and the desired steering direction of the interference pattern of the array. For the simple case of the invention having a planar exterior surface as shown in FIG. 2 and steering broadside to the plane of the array ports 2, sound arriving from (transmitted to) the far field should traverse the multiple waveguide channels 3 and arrive at the reduction (expansion) chamber 6 (port 2) end of each waveguide channel 3 in phase across all the waveguide channels 3, so all waveguide channels 3 will therefore be the same length; therefore, the travel time of the sound pressure wave down each of the waveguide channels 3 is identical.

Variations on this construction technique include, but are not limited to, waveguide channels 3 fabricated from rubber, metal, wood, or similar materials; waveguide channels 3 consisting of paths through solid materials and fabricated using subtractive manufacturing techniques such as a router or additive manufacturing techniques such as stereolithography (SLA); and the incorporation of valves, labyrinths, ports, baffles, and additional fluidic expansion chambers in the waveguide channels 3 design to shape the sound and allow real-time adjustment of various audio parameters of the device.

Figure 3:
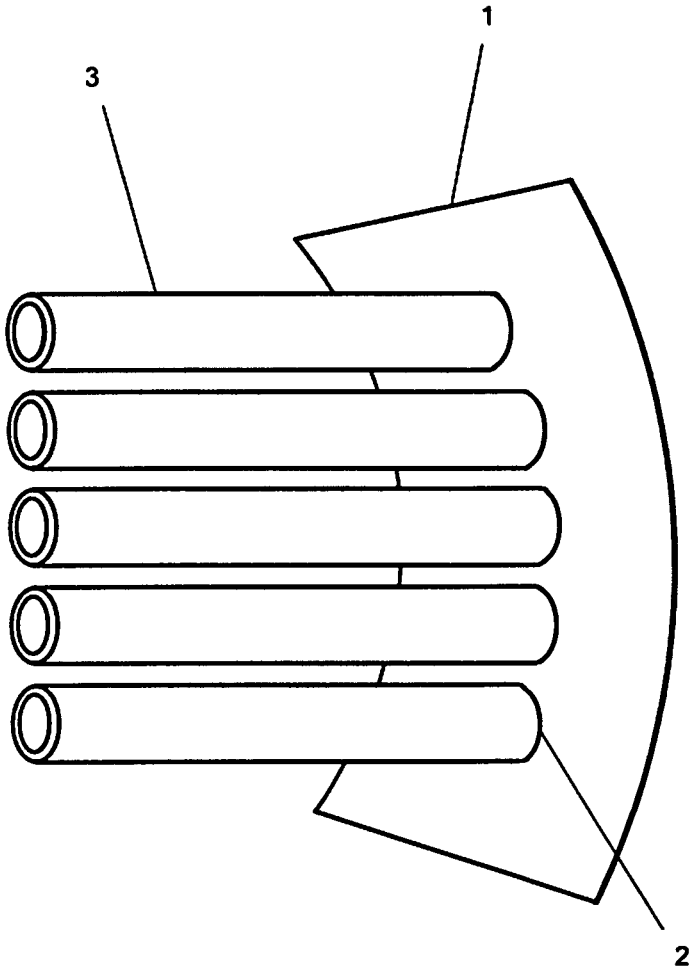
FIG. 3 is an illustration of an embodiment of individual waveguide channels and porting to a curved exterior terminating surface.

Referring now to an embodiment shown in FIG. 3, the curved exterior surface 1 (as opposed to the planar surface of FIG. 2) has port openings 2 for the sound pressure waves to pass either into or out of the waveguide channels 3. In more detail, still referring to the invention of FIG. 3, the waveguide channels 3 continue onto a reduction or expansion chamber 6 (shown in following figures).

The construction details of the invention as shown in FIG. 3 are, in most respects, identical to those of referenced to FIG. 2, with the exception of the lengths of the waveguide channels 3. As stated above, the length of each waveguide channel is determined by the shape of the exterior surface and the desired steering direction of the interference pattern of the array. For the case of an embodiment having a non-planar exterior surface and steering broadside to the plane of the array ports 2, sound arriving from (transmitted to) the far field should traverse the multiple waveguide channels 3 and arrive (depart) at the reduction (expansion) chamber 6 (to a plane tangent to the center of the pattern of array ports 2) end of each waveguide channel 3 in phase across all the waveguide channels 3; all waveguide channels 3 will therefore be the same length so that the travel time of the sound pressure wave down each of the waveguide channels 3 is identical, unless steering away from the broadside axis is desired.

Figure 4:
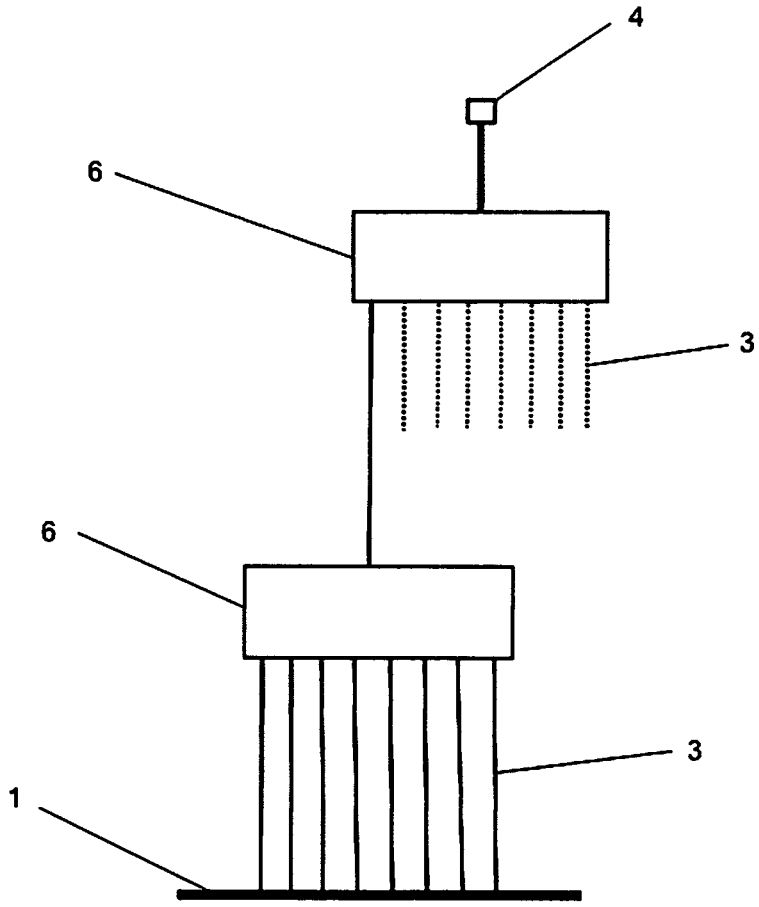
FIG. 4 is an illustration of an embodiment of a planar terminating surface and two stages of 8-to-1 channel reduction or expansion chambers.

Referring now to the invention shown in FIG. 4, the invention may include one or more stages of reduction or expansion chambers 6. FIG. 4 is an illustration of one embodiment of the invention with a planar terminating surface and two stages of 8-to-1 channel reduction (or expansion) chambers 6. The reduction (expansion) chambers 6 allow the invention to receive (transmit) sound from (to) a multiplicity of waveguide channels 3 whose ports 2 provide the appropriate interference pattern for the desired directivity.

In more detail, still referring to the invention of FIG. 4, there is a practical limit to how many stages of reduction or expansion chambers 6 are incorporated in a real device due to the accumulated impedance to the sound pressure wave as it travels the acoustic paths through the device.

The construction details of the invention as shown in FIG. 4 are, in this embodiment, straight forward. The component pieces are inter-connected according to the desired configuration of the array ports and the desired reduction (or expansion). Care needs to be taken to ensure that any bends in the waveguide channels are not so severe that they impede the sound pressure wave. Variations on this construction technique include, but are not limited to, zero (i.e. waveguide channels 3 leading directly to transducers without passing through an expansion or reduction chamber 6), single, and dual stage reduction (expansion) chambers 6; and waveguide channels 3 of different diameters.

Figure 5:
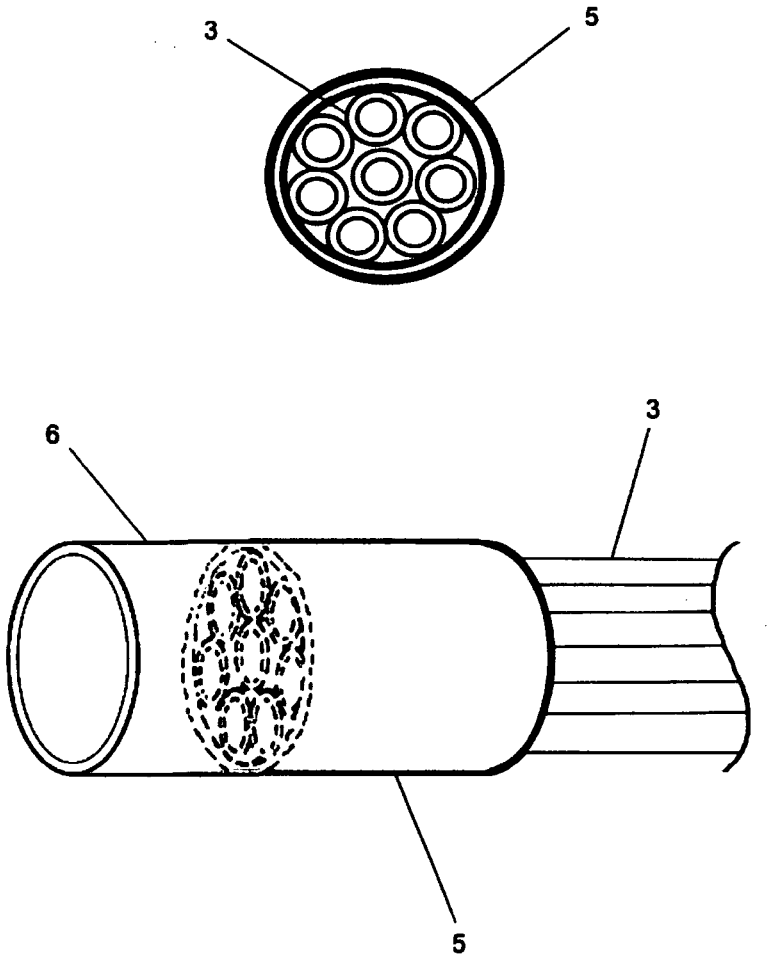
FIG. 5 is an illustration of an embodiment of a collar joining multiple waveguide channels and extending to form part of a reduction or expansion chamber.

Referring now to the invention shown in FIG. 5, a portion of the reduction or expansion chamber 6 is depicted as constructed in this embodiment using tubes for the waveguide channels 3. The chamber cap 4 (shown in a later figure) completes the reduction or expansion chamber 6. In more detail, still referring to the embodiment of the invention of FIG. 5, the waveguide channels 3 enter in to and are held by a collar 5. The collar 5 extends to form the main body of the reduction or expansion chamber 6.

The construction details of the invention as shown in FIG. 5 are, in this embodiment, the collar 5 which secures and directs the plastic tubes, which are used as waveguide channels 3. The tubular waveguide channels 3 are normally terminated evenly with each other to avoid undesired acoustic reflections and shading in the chamber 6.

Variations on this construction technique include, but are not limited to, waveguide channels 3 and reduction or expansion chambers 6 fabricated from rigid tubes, rods (where the acoustic signal is carried through the solid material instead of fluid media such as water or air), pathways mechanically routed or chemically etched in solid materials, and pathways formed in injection molded or SLA materials. For higher performance embodiments, the advantages of using waveguide channels through solid materials offers decreased impedance to the reception or transmission of sound through the device.

Figure 6:
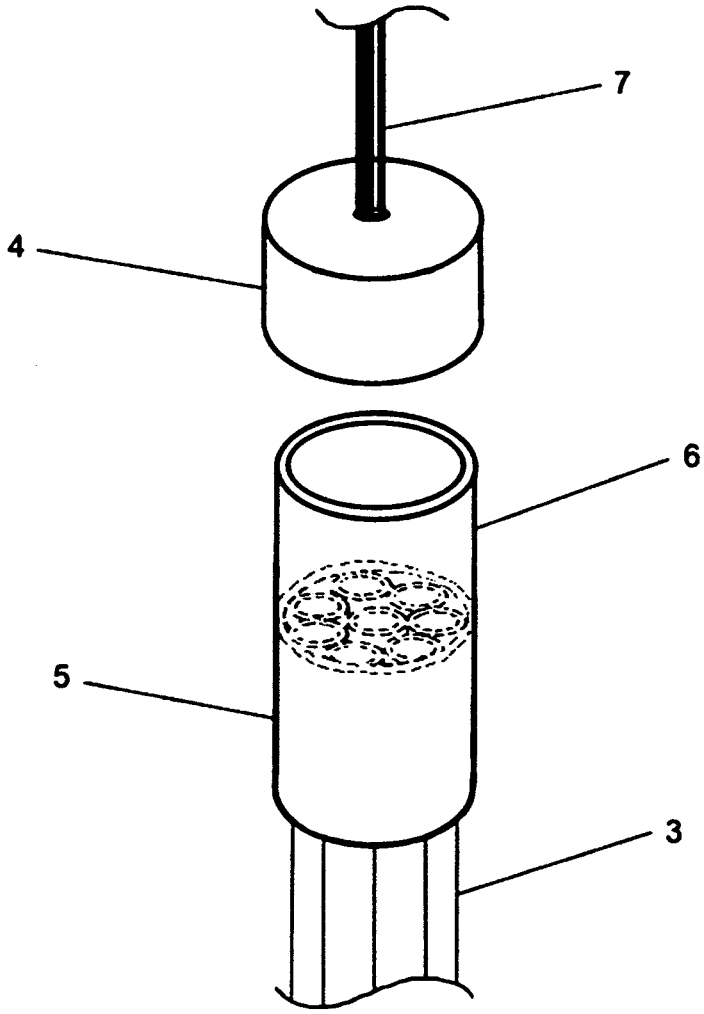
FIG. 6 is an illustration of an embodiment of a reduction or expansion chamber.

Referring now to the invention shown in FIG. 6, a complete reduction or expansion chamber 6 is depicted as constructed in this embodiment, along with tubes for the waveguide channels 3 and the transducer's electrical cable 7. In more detail, still referring to the embodiment of the invention of FIG. 6, the waveguide channels 3 enter and are held by a collar 5. The collar 5 extends to form the main body of the reduction or expansion chamber 6. The construction details of the invention as shown in FIG. 6 are, in this embodiment, the main, hollow body of the chamber once closed by the chamber cap 4 provides the resonant cavity which acts as a mechanical amplifier of the received (transmitted) sound, while also serving as the means to accomplish the reduction (expansion). The dimensions of the reduction or expansion chamber are engineered to accomplish parametric amplification and frequency filtering in the desired frequency band. For example, in air, a ¼ wavelength amplifier at 3 kilohertz requires a length of approximately 3 centimeters for the hollow body of the reduction or expansion chamber 6. If the sound pressure wave's transmitting media is water instead of air, the length will need to be adjusted accordingly due to the higher density of water as compared to air.

Variations on this construction technique include, but are not limited to, waveguide channels 3 and reduction or expansion chambers 6 fabricated from rigid tubes, rods (where the acoustic signal is carried through the solid material instead of fluid media such as water or air); pathways routed in solid materials; pathways formed in injection molded or SLA materials; the incorporation of valves, labyrinths, ports, and baffles in the reduction or expansion chamber 6 design; the incorporation of a fluidic amplifier for low noise amplification; and, the incorporation of other types of transducers, such as pressure gradient microphones, ribbon microphones, hot-wire microphones, particle velocity probes, vector sensors, hydrophones, spark-gap transmitters, loudspeakers, horns, and sirens.

Figure 7:
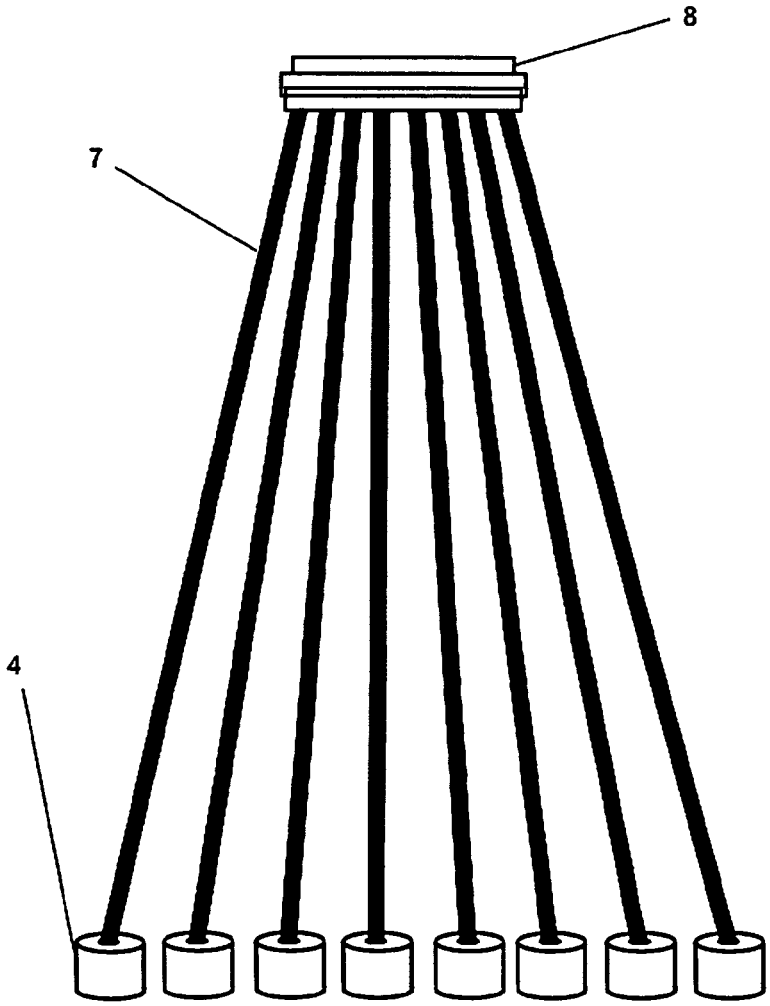
FIG. 7 is an illustration of an embodiment of multiple transducer electrical cables.

Referring now to the invention shown in FIG. 7, the electrical connection of the transducers (not shown, but mounted in the chamber caps 4) to the electrical connector 8 is depicted. In more detail, still referring to the embodiment of the invention of FIG. 7, the multiple transducer electrical cables 7 connect the transducers (not shown, but mounted in the chamber caps 4) to the electrical connector 8 in an embodiment of the invention. The electrical cables 7 carry signals from (to) the transducers as well as provide power to the transducers. The electrical connector 8 provides electrical connectivity to the electronics module 9 (shown in later figure).

The construction details of the invention as shown in FIG. 7 are, in this embodiment, typical electrical cables with three conductors carrying signal, power, and ground. Variations on this construction technique include, but are not limited to, use of printed circuit board traces to carry the signal, power, and ground; the use of wireless transmitter(s) to carry the signals; the addition of an extra stage of reduction or expansion chamber 6 thereby reducing the number of electrical cables 7; and, the use of mechanically powered transducers requiring no electrical cables 7.

Figure 8:
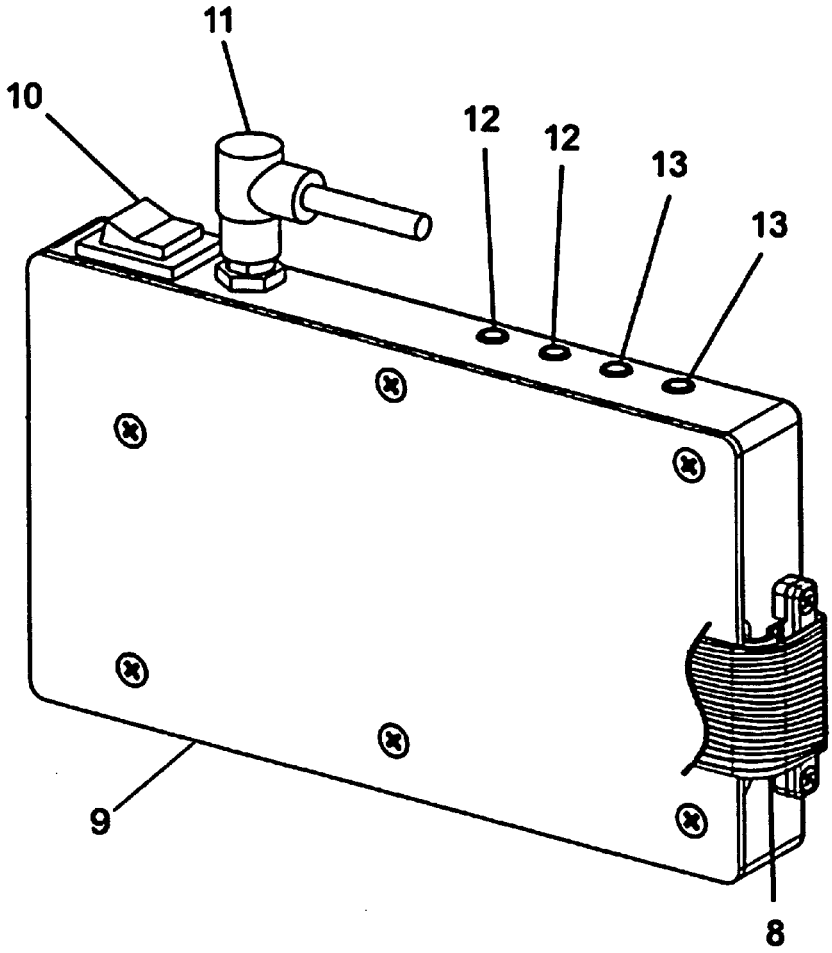
FIG. 8 is an isometric illustration of an embodiment of an electronics module.

Referring now to the invention shown in FIG. 8, the electronics module 9 connects through the electrical cables 7 to at least one transducer, through the input connections 12 to audio source signals for transmission by the invention, and through the output connections 13 to audio monitoring, broadcast, and recording equipment for appropriate handling of the audio received by the invention.

In more detail, still referring to the invention of FIG. 8, the electronics module 9 includes circuitry and other components to allow it to perform spatial filtering, linear and automatic gain control, noise reduction filtering, and signal output at multiple levels, including microphone, headphone, and/or line levels. It also provides for input and output of a general reference microphone channel, which is not beamformed and provides a representation of the sounds reaching the array or its vicinity, depending on the location of the reference microphone. The electronics module includes an on/off switch 10 and power cable connection 11, which provides DC power from a remote battery pack or other electrical power source. In addition, the housing of electronics module 9 provides input 12 and output 13 connection interfaces. The construction details of the invention as shown in FIG. 8 are, in this embodiment, an external housing, encasing a multi-layer PCB (printed circuit board) with accompanying switch, electrical jacks, and wiring. The filtering and other processing performed on the PCB are accomplished using primarily analog electronic components.

Other variations on this construction technique include, but are not limited to, embedding the electronics contained in the electronics module housing inside of other housings or devices; using digital electronics, including DSPs (digital signal processors), ASICs (application specific integrated circuits), FPGA (field programmable gate arrays) and similar technologies, to implement generally the same signal processing using digital devices as is being accomplished using analog and hybrid devices in the this embodiment.

Figure 9:
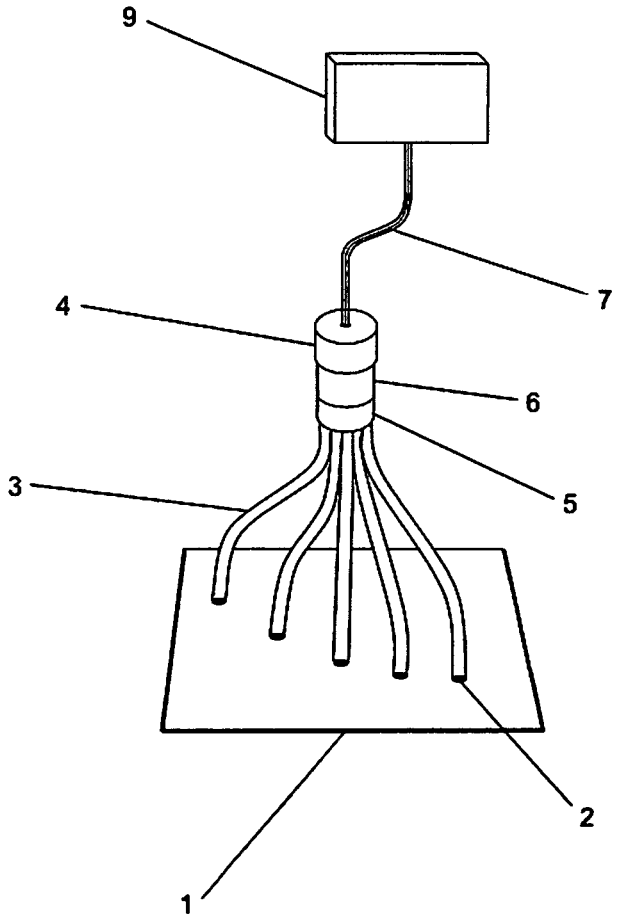
FIG. 9 is an illustration of an embodiment of the invention operating as a single microphone array.

Referring now to the invention shown in FIG. 9, the waveguide channels 3 are interconnected physically to the planar terminating surface 1 allowing the waveguide ports 2 access to the exterior environment into which the sound will be transmitted, or from which it will be received. The reduction or expansion chamber 6 provides resonant amplification and interfaces the sound path to or from the environment to the transducer (in the chamber cap 4). The electrical cable 7 connects the transducer (in the chamber cap 4) to the electronics module 9.

The construction details of the invention as shown in FIG. 9 are, in this embodiment, a series of plastic tubular waveguides attached to the terminating surface 1, ports 2 using adhesive on one end and held by the plastic collar 5 in the plastic reduction-expansion chamber 6. An electrically-powered transducer is mounted in the end of the chamber cap 4 and interfaces with a remote electronics module 9 through the electrical cable 7.

Variations on this construction technique include, but are not limited to, the use of wireless links to replace one or more cables; the integration of the electronics contained in the electronics module onto the reduction or expansion chamber; the addition of waveguide channels, expansion or reduction chambers, and transducers; the addition of switching circuitry to allow selection between sets of waveguides with different characteristics in order to provide real-time control of the audio shaping and steering control of the interference pattern; and the addition of timing circuitry to cause the transducers to operate in- or out-of-phase with each other to provide real-time electronic steering control of the overall interference pattern.

The advantages of the present invention include, without limitation, (a) directional audio system for transmission and/or reception;
(b) increased immunity to environmental noises, temperature, and humidity;
(c) low cost of construction;
(d) high reliability;
(f) light weight;
(g) simplicity of operation;
(h) very low power consumption;
(i) fixed or real-time steering of its directivity (interference) pattern;
(j) wide range of audio powers that can be transmitted or received; and
(k) interchangeable transducer types.

In broad embodiment, the present invention is a directional audio system which can be used as a microphone (receiving) or loudspeaker (rendering) audio array, but can also be employed in acoustic holography, underwater acoustic, and insonification applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the appended claims.

What is claimed is:

1. A directional waveguide array apparatus comprising:

a planar exterior surface, the planar exterior surface having a plurality of apertures defining waveguide ports, the plurality of apertures being arranged on the planar exterior surface according to a predetermined interference pattern;

a plurality of waveguide channels coupled to the planar exterior surface in alignment with the plurality of apertures, the plurality of waveguide channels comprising substantially varying tubular lengths corresponding to the predetermined interference pattern;

at least one-combining chamber coupled to a terminal portion of the plurality of waveguide channels, the at least one combining chamber having an interior portion defining a resonant cavity operable to interface a sound path from the plurality of waveguide channels to at least one transducer;

a plurality of transducer electrical cables operably engaged with the at least one transducer and at least one electrical connector; and, an electronics module operably engaged with the at least one electrical connector, the electronics module comprising:

a printed circuit board having filtering, gain control, and input-output circuitry;

at least one output channel operably engaged with the printed circuit board; and at least one input channel operably engaged with the printed circuit board.

2. The directional waveguide array apparatus of claim 1 wherein the waveguide channels are substantially flexible tubes.

3. The directional waveguide array apparatus of claim 1 wherein the plurality of apertures are arranged on the planar exterior surface in a pattern selected from the group consisting of logarithmic spiral, equal, random, fractal, Golden Spiral, and Fibonacci.

4. The directional waveguide array apparatus of claim 1 wherein the at least one transducer is selected from the group consisting of pressure gradient microphones, mechanically powered transducers, ribbon microphones, hot-wire microphones, vector sensors, particle velocity probes, hydrophones, spark-gap transmitters, loudspeakers, horns, and sirens.

5. The directional waveguide array apparatus of claim 1 further comprising switching circuitry operably engaged with the printed circuit board and configured to select predetermined waveguide sets.

6. A directional waveguide array apparatus comprising:

a terminating surface, the terminating surface having a plurality of apertures defining waveguide ports;

a plurality of waveguide channels coupled to the terminating surface in alignment with the plurality of apertures;

a collar coupled to a terminal end of the plurality of waveguide channels;

a reduction-expansion chamber coupled to the collar, the reduction-expansion chamber having a housing with interior walls defining a resonant cavity and at least one transducer coupled to an interior surface of the reduction-expansion chamber;

a plurality of transducer electrical cables operably engaged with the at least one transducer and at least one electrical connector; and an electronics module operably engaged with the at least one electrical connector, the electronics module comprising:

a printed circuit board having filtering, gain control, and input-output circuitry;

at least one output channel operably engaged with the printed circuit board; and at least one input channel operably engaged with the printed circuit board.

7. The directional waveguide array apparatus of claim 6 wherein the terminating surface is configured in a shape selected from the group consisting of planar, curved, and irregular.

8. The directional waveguide array apparatus of claim 6 wherein the plurality of waveguide ports are arranged on the terminating surface in a pattern selected from the group consisting of logarithmic spiral, equal, random, fractal, Golden Spiral, and Fibonacci.

9. The directional waveguide array apparatus of claim 6 further comprising an electrical bus connected to the at least one transducer operable to carry signals from the at least one transducer and provide power to the at least one transducer.

10. The directional waveguide array apparatus of claim 6 wherein the waveguide channels are fabricated from the group consisting of substantially flexible tubes, solid rods, and rigid tubes.

11. The directional waveguide array apparatus of claim 6 wherein the at least one transducer is mechanically powered.

12. The directional waveguide array apparatus of claim 6 wherein the at least one transducer is selected from the group consisting of pressure gradient microphones, mechanically powered transducers, ribbon microphones, hot-wire microphones, vector sensors, particle velocity probes, hydrophones, spark-gap transmitters, loudspeakers, horns, and sirens.

13. The directional waveguide array apparatus of claim 6 further comprising a plurality of reduction-expansion chambers coupled to a plurality of collars.

14. The directional waveguide array apparatus of claim 10 wherein the length of the waveguide channels is directly correlated to a predetermined interference pattern.

15. A directional waveguide array apparatus comprising:

a terminating surface, the terminating surface having a plurality apertures defining waveguide ports;

a plurality of waveguide channels coupled to the terminating surface in alignment with the plurality of apertures;

a collar coupled to a terminal end of the plurality of waveguide channels;

a reduction-expansion chamber coupled to the collar, the reduction-expansion chamber having a housing with interior walls defining a resonant cavity;

a chamber cap coupled to the reduction-expansion chamber, the chamber cap having at least one transducer coupled to a portion of the chamber cap;

a plurality of transducer electrical cables operably engaged with the at least one transducer and at least one electrical connector; and an electronics module operably engaged with the at least one electrical connector, the electronics module comprising:

a printed circuit board having filtering, gain control, and input-output circuitry;

at least one output channel operably engaged with the printed circuit board; and at least one input channel operably engaged with the printed circuit board.

16. The directional waveguide array apparatus of claim 15 wherein the plurality of waveguide ports are arranged on the terminating surface in a pattern selected from the group consisting of logarithmic spiral, equal, random, fractal, Golden Spiral, and Fibonacci.

17. The directional waveguide array apparatus of claim 15 wherein the electronics module is integrated onto the reduction-expansion chamber.

18. The directional waveguide array apparatus of claim 15 further comprising switching circuitry operably engaged with the printed circuit board and configured to select predetermined waveguide sets.

19. The directional waveguide array apparatus of claim 15 further comprising timing circuitry operably engaged with the printed circuit board and configured to operate phases of the at least one transducer.

20. The directional waveguide array apparatus of claim 15 further comprising switching circuitry operable to select between the plurality of waveguides and steer control of an interference pattern.

* * * * *